US005383607A

United States Patent [19]

Heyse et al.

[11] Patent Number: 5,383,607

[45] Date of Patent: Jan. 24, 1995

[54] ELECTROMAGNETICALLY ACTUATED INJECTION VALVE

[75] Inventors: Joerg Heyse, Gerlingen; Volker Holzgrefe, Ditzingen, both of Germany

[73] Assignee: Robert Bosch GmbH, Stuttgart, Germany

[21] Appl. No.: 979,680

[22] Filed: Nov. 20, 1992

[30] Foreign Application Priority Data

Dec. 19, 1991 [DE] Germany ..... 4141930

[51] Int. Cl.[6] ..... B05B 1/30; F02M 51/00

[52] U.S. Cl. ..... 239/585.4

[58] Field of Search ..... 251/129.21, 333; 239/585.1–585.5, 533.12, 590.3, 590.5

[56] References Cited

U.S. PATENT DOCUMENTS

| | | | |
|---|---|---|---|
| 2,927,737 | 3/1960 | Zeuch et al. | 251/333 X |
| 2,973,008 | 2/1961 | Klose | 251/333 X |
| 4,417,697 | 11/1983 | Claxton et al. | 239/533.12 |
| 4,531,678 | 7/1985 | Knapp | 239/585.1 X |
| 4,662,567 | 5/1987 | Knapp | 239/585.4 |
| 4,711,400 | 12/1987 | Radaelli et al. | 239/585.4 |
| 4,890,794 | 1/1990 | Imafuku et al. | 239/533.12 |
| 4,934,605 | 6/1990 | Hans et al. . | |
| 5,002,231 | 3/1991 | Reiter et al. | 239/585.1 |

FOREIGN PATENT DOCUMENTS 2150978 7/1985 United Kingdom .

*Primary Examiner*—Andres Kashnikow
*Assistant Examiner*—Kevin P. Weldon
*Attorney, Agent, or Firm*—Edwin E. Greigg; Ronald E. Greigg

[57] ABSTRACT

An electromagnetically actuatable injection valve, including a nozzle with a shaped end face in combination with a perforated plate through which the fuel flows. The nozzle injection valve has an injection chamber which is defined by a downstream terminal face of the valve closing element and by the perforated plate which is spaced from the nozzle and provided with injection ports. The geometrical embodiment of the injection chamber influences the fuel flow in such a way that a pulse flow vector of the flow penetrates an imaginary jacket face at right angles, so that the injection ports are acted upon substantially by pressure energy. The novel injection valve is especially suitable for fuel injection systems of mixture-compressing internal combustion engines with externally supplied ignition.

5 Claims, 2 Drawing Sheets

ELECTROMAGNETICALLY ACTUATED INJECTION VALVE

BACKGROUND OF THE INVENTION

The invention is based on an electromagnetically actuatable injection valve as defined hereinafter. U.S. Pat. No. 4,934,605 has already disclosed an electromagnetically actuatable injection valve that has a valve needle which upon excitation of a magnet coil is pulled against a core by an armature joined to the needle, causing the valve needle, with a sealing seat formed on it, to lift away from a conical valve seat face embodied on a nozzle body. The valve needle has a terminal cone adjoining a cylindrical segment in the flow direction, and this cone in turn changes into an again-cylindrical terminal protrusion. The sealing seat is embodied as a rounded area at the transition between the cylinder segment and the terminal cone. The contour of the rounded area traces an external jacket face of an imaginary torus, with a longitudinal valve needle axis as its center point.

Metering the fuel is done in injection ports, which are disposed in a perforated plate that covers a downstream terminal opening of the nozzle body.

The narrow annular gap between the valve needle and the valve seat face that is exposed upon opening of the injection valve leads to high flow velocities of the fuel. The flow losses that occur in the annular gap because of the viscosity of the fuel depend linearly on the flow velocity, so that a high flow velocity in the annular gap leads to a high pressure loss in the fuel flow.

Because of the geometry of the valve needle, the pulse flow vector of the fuel flow is oriented strongly in the direction of the injection ports over the entire path between the annular gap and the injection ports, resulting in anisotropic distribution of the fuel quantity injected through the various injection ports.

Tests of the injection valve with substitute fluids for commercially available fuel have been carried out in order to record characteristic curves and to test the operating performance. If accurate statements on the injection valve are to be made from these model tests, the hydraulic similarity must remain assured despite the different parameters of the substance, such as the viscosity of the substitute fluid. The orientation of the pulse flow vector of the fuel flow in the direction of the injection ports over the path between the annular gap in the injection ports makes it more difficult to maintain the hydraulic similarity when substitute fluids are used.

OBJECT AND SUMMARY OF THE INVENTION

The electromagnetically actuatable injection valve according to the invention, has an advantage over the prior art that the at least one injection port is acted upon essentially only with pressure energy. As a result, in the event that a perforated plate has a plurality of injection ports, a uniform distribution of the quantities of fuel output by the various injection ports is attained, so that the injection cone produced by the injection valve has a symmetrical shape, and the attendant homogeneous droplet distribution assures uniform combustion of the mixture in the combustion chamber of an internal combustion engine. Because the pulse flow vector of the flow is aligned parallel to the perforated plate, a pronounced deflection of the flow into the injection ports occurs. As a result, a unilateral detachment of the flow in the injection ports can be attained. Experiments have shown that such flow detachments have a controlling effect on the flow and thus lessen the deviation in the flow quantity between different injection valves.

An acceleration of the flow, resulting in a pronounced pressure drop, is prevented because of a flow cross section that kept constant in an annular gap at the sealing seat in the direction of the injection port. By increasing the axial spacing between the downstream end face of the valve closing part and the perforated plate as the distance from the longitudinal valve axis decreases, a shrinkage in size of the intervening flow cross section is avoided. As a result, there is virtually no acceleration or retardation of the flow. The absence of flow acceleration reduces the velocity-depended flow losses. The absence of flow retardation reduces flow instabilities and nonhomogeneous pulse distributions upstream of the perforated plate.

A suitable selection of the shape a recess on a downstream end face of the valve closing element or on a side of the perforated plate toward the valve closing element makes a purposeful variation of the flow possible.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
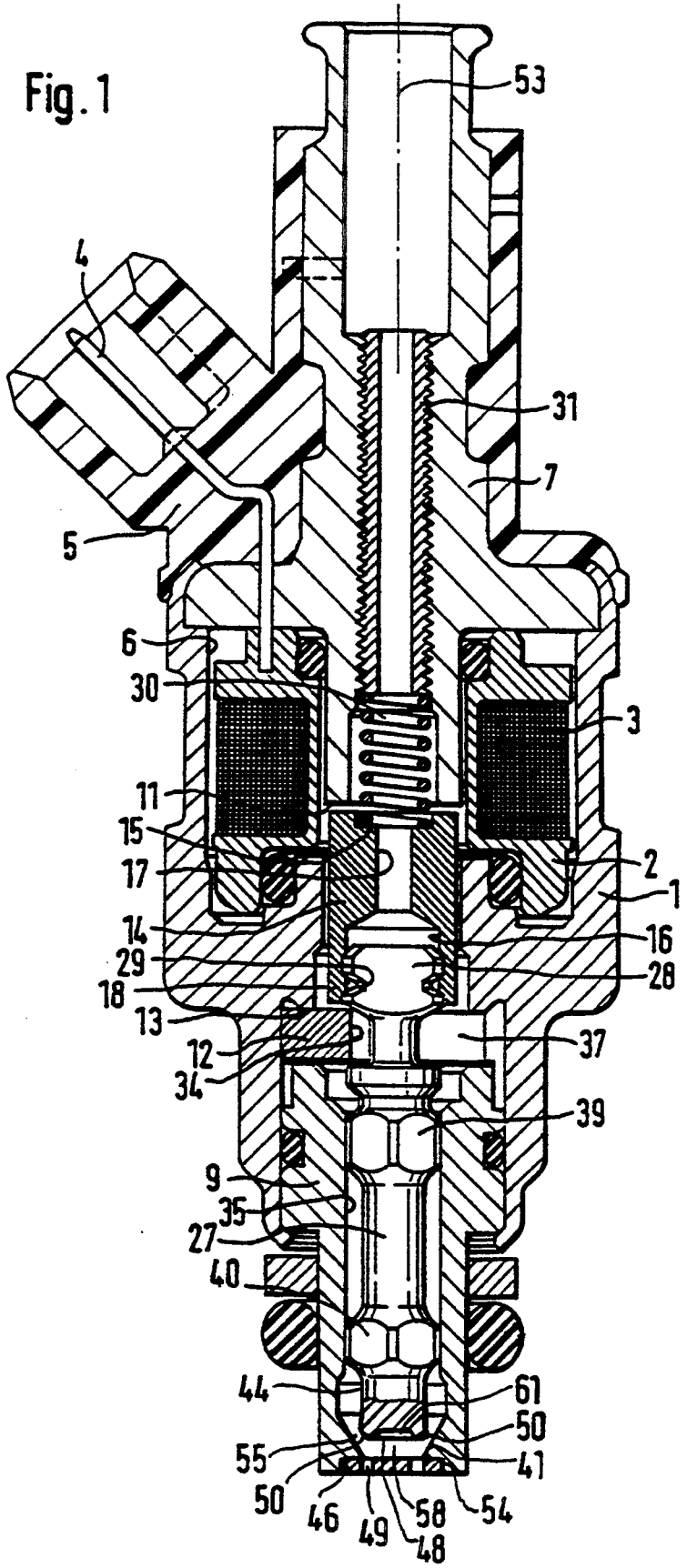
FIG. 1 shows an exemplary embodiment of an injection valve embodied according to the invention.

The injection valve, shown by way of example in the drawing, for a fuel injection system of a mixture-compressing internal combusting engine with externally supplied ignition has a valve housing 1 of ferromagnetic material, in which a magnet coil 3 is disposed on a coil holder 2. The magnet coil 3 has electrical current supplied to it via a plug connection 4, which is embedded in a plastic ring 5 that surrounds a portion of the valve housing 1.

The coil holder 2 of the magnet coil 3 is seated in a coil chamber 6 of the valve housing 1 surrounding a connection piece 7 that delivers the fuel and which protrudes partly into the valve housing 1. Remote from the connection piece 7, the valve housing 1 partly surrounds a nozzle body 9.

A cylindrical armature 14 is located between an end face 11 of the connection piece 7 on an upper end and a stop plate 12 on a lower end, which is mounted on an inner shoulder 13 of the valve housing 1 and has a predetermined thickness for the sake of accurate adjustment of the valve. The armature 14 comprises a magnetic material that is not vulnerable to corrosion, and it is located with slight radial spacing from a magnetically conductive shoulder of the valve housing 1, in this way forming an annular magnetic gap coaxially in the valve housing 1 between the armature 14 and the shoulder. The cylindrical armature 14 is provided with a first coaxial blind bore 15 in an upper end and a second coaxial blind bore 16 on a lower end, beginning at its two end faces; the second coaxial blind bore 16 opens toward the nozzle body 9. The first and second coaxial blind bores 15 and 16 communicate with one another through a coaxial opening 17. The diameter of the opening 17 is smaller than the diameter of the second coaxial blind bore 16. The end segment of the armature 14 oriented toward the nozzle body 9 is embodied as a deformation region 18. The task of this deformation region 18 is to join the armature 14 form-fittingly to a valve closing element 27, by fitting around a retaining body 28 that forms part of the valve closing element 27 and fills the second coaxial blind bore 16. The grip around the retaining body 28 on the part of the deformation region 18 of the armature 14 is obtained by pressing material from the deformation region 18 into groove 29 located on the retaining body 28. In the exemplary embodiment shown, the valve closing element 27 is embodied as a valve needle.

A compression spring 30 rests by one end on the bottom of the first coaxial blind bore 15, and on its other end it rests on a tube insert 31 secured in the connection piece 7 by screw threads or wedging. The compression spring 30 acts upon the armature 14, and hence the valve closing element 27 with a force oriented away from the connection piece 7.

The valve closing element 27 passes with radial spacing through a through bore 34 in the stop plate 12 and is guided in a guide bore 35 of the nozzle body 9. In the stop plate 12, a slit 37 is provided, leading from the through bore 34 to the circumference of the stop plate 12; the diameter of the through bore 34 inside the slit is larger than the diameter of the valve closing element 27 in its region surrounded by the stop plate 12.

The valve closing element 27 has two guided segments 39 and 40, which provide guidance for the valve closing element 27 in the guide bore 35 and leave open an axial passage for the fuel. The guide segments are provided with cut faces which make the guide segment substantially square, for example. On its downstream end, the guide bore 35 changes into a conically embodied valve seat face 41. The downstream guide segment 40 of the valve closing element 27 is adjoined by a cylinder segment 44 of lesser diameter. Toward a disk-like perforated plate 46, the cylinder segment 44 terminates in a terminal face 48. The perforated plate 46 has at least one and for instance 3 injection ports 49, through which the fuel is injected and metered downstream of the valve seat face 41. The perforated plate is fitted into a shoulder 54 of a nozzle body 9 and joined firmly to it, for instance by welding or soldering. The transition from the cylinder segment 44 to the terminal face 48 is embodied as a rounded area 50. The rounded area 50 of the valve closing element 27 and the valve seat face 41 of the nozzle body 9 form a sealing seat 50,41. When current is flowing through the magnet coil 3, the valve closing element 27 lifts away from the valve seat face 41 in the direction of a longitudinal valve axis 53 and exposes a narrow annular gap 55 between the valve seat face 41 and the rounded area 50 of the valve closing element 27, through which gap the fuel flows in the direction of the injection port 49. Because of the small cross section of the annular gap 55, the fuel is markedly accelerated within the gap.

A disk-like injection chamber 58, according to the invention located upstream of the injection port 49 and defined by the perforated plate 46 and the terminal face 48 of the valve closing element 27, is oriented substantially at a right angle to the longitudinal valve axis 53. The result is a pulse flow vector 60 that characterizes the force and direction of the fuel flow and which passes through an imaginary jacket face 65 extending parallel to and concentrically around the longitudinal valve axis 53; this face 65 has a diameter D and an axial spacing H between the terminal face 48 and the perforated plate 46 parallel to the longitudinal valve axis 53 and is oriented substantially at right angles to the longitudinal valve axis. The sum of the pulse vectors in the direction of the longitudinal valve axis 53 and hence in the direction of the injection ports 49 is 0, contrarily, so that the injection ports 49 are acted upon almost exclusively by pressure energy. The outflow of the fuel from the injection ports 49 is determined in a first approximation by the pressure difference between the injection chamber 58 and the outer chamber surrounding the injection ports 49 downstream, and by the geometry of the individual injection ports 49.

The pressure inside the injection chamber 58 is largely a location-independent variable, so that the same pressure drop prevails at each injection port 49, and each injection port 49 gives up an identical quantity of fuel, and the injection cone has a desired symmetrical shape. The size and orientation of the fuel stream outlet velocity is not determined until in the individual injection ports 49. A preferential output of fuel through a particular single injection port 49 is avoided.

The suitable embodiment of the shape of both the terminal face 48 of the valve closing element 27 and of the side of the perforated plate 46 oriented toward the valve closing element 27 permits a purposeful variation of the fuel flow in the injection chamber 58, without accelerating the fuel flow. By increasing the axial spacing between the terminal face 48 of the valve closing element 27 and the perforated plate 46 with decreasing distance from the longitudinal valve axis 53, a reduction in size of the flow cross section for the fuel located in between the sealing seat, beginning at the annular gap 55 at the sealing seat 41, 50, is avoided. In the ideal case, a flow cross section of constant course will be attained in this way, without flow acceleration or retardation. The absent flow acceleration reduces the velocity-dependent flow losses. The absent flow retardation avoids the attendant flow instabilities and nonhomogeneous pulse distributions upstream of the injection ports 49.

Figure 2:
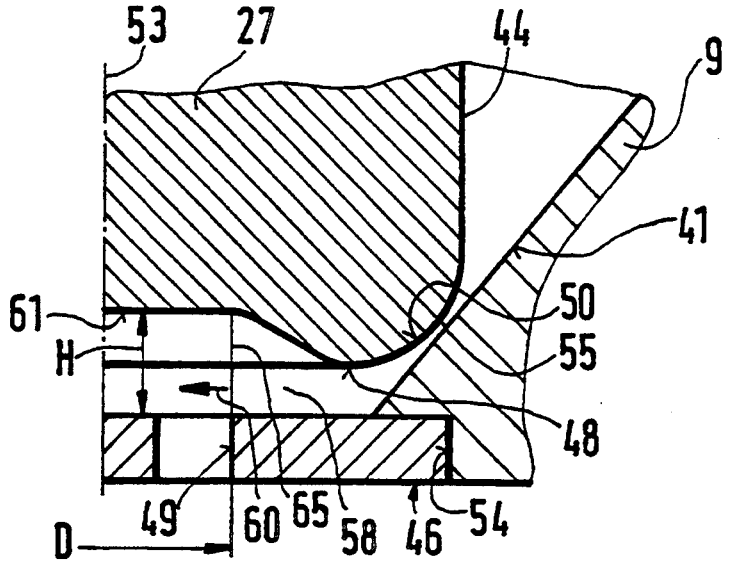
FIG. 2 is a fragmentary view, on a larger scale, of the inventive portion of the first exemplary embodiment of FIG. 1.

FIG. 2, in a fragmentary view on a larger scale, as the first exemplary embodiment, shows the region around the sealing seat 41, 50 of the injection valve of FIG. 1, with a valve closing element 27 whose terminal face 48 has a tub-shaped recess 61 beginning at the rounded area 50; this recess 61 means that the flow cross section of the fuel flow in the injection chamber 58 between the terminal face 48 and the perforated plate 46 is kept constant, with the aforementioned resultant properties. The side of the perforated plate 46 oriented toward the valve closing element 27 is embodied as flat.

Figure 3:
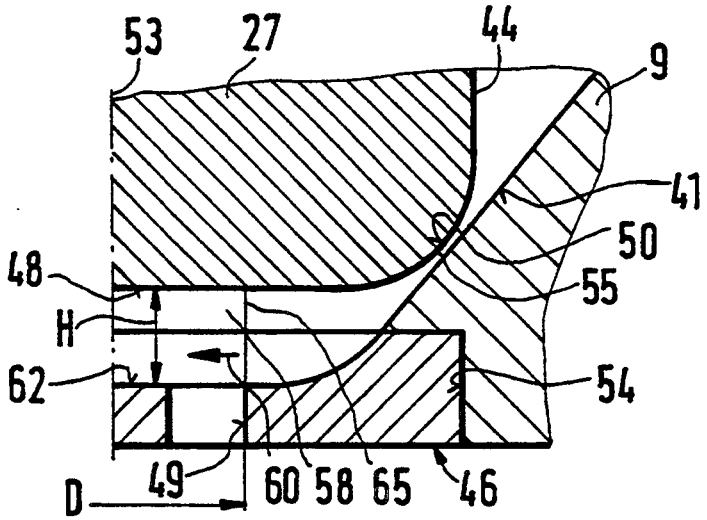
FIG. 3 is a fragmentary view, on a larger scale, of the inventive portion of a second exemplary embodiment of the injection valve.

FIG. 3, in a fragmentary view on a larger scale shows the region around the sealing seat 41, 50 of the injection valve, in a second exemplary embodiment, with a flat terminal face 48 of the valve closing element 27 and a perforated plate 46 that has a tub-shaped recess 62 on the side toward the valve closing element 27. The tub-shaped recess 62 is embodied such that in the manner described above, the flow cross section for the fuel flow in the injection chamber 58 is kept constant as the distance from the longitudinal valve axis decreases, so that the aforementioned advantageous properties are achieved.

Figure 4:
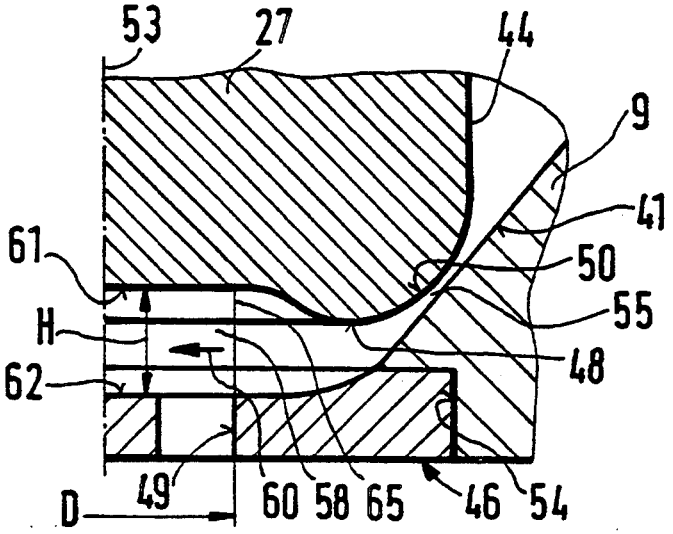
FIG. 4 is a fragmentary view, on a larger scale, of the inventive portion of a third exemplary embodiment of the injection valve.

An effect that is reinforced compared with the above two exemplary embodiments is attained with a third exemplary embodiment shown in FIG. 4. Both the side of the perforated plate 36 oriented toward the valve closing element 27 and the terminal face 48 of the valve closing element 27 have one tub-shaped recess 61, 62 each. The two recesses 61, 62 face one another. By a suitable embodiment of the cross section in the recesses 61, 62, the flow cross section for the fuel flow remains constant as the distance from the longitudinal valve axis 53 decreases as attained in the manner described above, beginning at the annular gap 55 at the sealing seat 41, 50.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. An electromagnetically actuatable injection valve for fuel injection systems, having a valve closing element that is actuatable by an armature in a direction of a longitudinal valve axis, said valve closing element includes a valve face (50) that cooperates with a valve seat face (41), to form a sealing seat (41, 50) and downstream of the sealing seat said valve closing element has a terminal face (48) that is oriented toward a perforated plate spaced from said terminal face and having at least one injection port, wherein beginning at the sealing seat between the terminal face and the perforated plate a flow cross section for the fuel flow is formed, the fuel flow between the terminal face (48) of the valve closing element 27 and the perforated plate (46) takes place as far as the at least one injection port (49) toward the longitudinal valve axis (53), and the terminal face (48) and the perforated plate (46) are configured such that beginning at the sealing seat (41, 50), an increase in an axial spacing (H) between the terminal face (48) and the perforated plate (46) results as a distance from the longitudinal valve axis (53) decreases, in such a manner that the flow cross section area for the fuel flow from the sealing seat (41, 50) to the at least one injection port (49) remains virtually constant and that said axial spacing (H) is constant in the radial direction from said at least one injection part (49) to said valve axis (53).

2. A valve as defined by claim 1, in which the downstream terminal face (48) of the valve closing element (29) has a tub-shaped recess (61).

3. A valve as defined by claim 1, in which a tub-shaped recess (62) is embodied on a side of the perforated plate (46) toward the valve closing element (27).

4. A valve as defined by claim 2, in which a tub-shaped recess (62) is embodied on a side of the perforated plate (46) toward the valve closing element (27).

5. A valve as defined in claim 1, in which the downstream terminal face (48) of the valve closing element and an upper face of the perforated plate (46), each have a tub-shaped recess.

* * * * *